US005685499A

United States Patent [19]

Gimmy

[11] Patent Number: 5,685,499

[45] Date of Patent: Nov. 11, 1997

[54] DEVICE AND PROCESS FOR THE COMMINUTION OF MATERIALS

[75] Inventor: Manfred Gimmy, Soemmerda, Germany

[73] Assignee: K. R. Pfiffner AG, Thalwil, Switzerland

[21] Appl. No.: 596,374

[22] PCT Filed: Aug. 18, 1994

[86] PCT No.: PCT/EP94/02741

§ 371 Date: Mar. 25, 1996

§ 102(e) Date: Mar. 25, 1996

[87] PCT Pub. No.: WO95/05898

PCT Pub. Date: Mar. 2, 1995

[30] Foreign Application Priority Data

Mar. 16, 1991 [DE] Germany ..... 44 08 964.3
Aug. 24, 1993 [DE] Germany ..... 42 28 398.5

[51] Int. Cl.[6] ..... B02C 18/02

[52] U.S. Cl. ..... 241/30; 241/32; 241/100; 241/205; 241/206; 241/166

[58] Field of Search ..... 241/166, 32, 285.2, 241/266, 205, 206, 217, 36, 30, 204, 100

[56] References Cited

U.S. PATENT DOCUMENTS

| | | | |
|---|---|---|---|
| 364,480 | 6/1887 | Christy et al. | 241/219 |
| 1,053,220 | 2/1913 | Ribeyron | 241/266 |
| 2,326,215 | 8/1943 | Gruender | 241/32 |
| 2,675,181 | 4/1954 | Tebow | 241/266 |
| 2,772,053 | 11/1956 | Schmidtmann | 241/266 X |
| 2,999,651 | 9/1961 | Ault et al. | 241/266 X |
| 3,346,202 | 10/1967 | Wuthrich . | |
| 5,078,327 | 1/1992 | Kemetter | 241/166 X |

FOREIGN PATENT DOCUMENTS

| | | | |
|---|---|---|---|
| 2664834 | 1/1992 | France . | |
| 49133 | 3/1889 | Germany . | |
| 2420913 | 11/1975 | Germany . | |
| 4139093 | 6/1992 | Germany | 241/266 |

*Primary Examiner*—Mark Rosenbaum
*Attorney, Agent, or Firm*—Foley & Lardner

[57] ABSTRACT

A material comminution device has a housing. Cutters extend within the housing and move toward each other in a scissor-like manner. The cutters extend parallel to each other along a bottom portion and diverge along a top portion, and consist of comb-like rows of spaced blades that mesh with each other. The blades carry out at the same time a shearing movement and a swivelling movement around an axis by means of a crank mechanism.

20 Claims, 3 Drawing Sheets

DEVICE AND PROCESS FOR THE COMMINUTION OF MATERIALS

The present invention concerns a device and process for the comminution of materials, such as comminutable material originating from industries or from private households. In particular, the present invention concerns the comminution of difficultly recyclable wastes, especially those from cutting processes, e.g. metal shavings, cheque cards, tapes and the like.

Metal shavings represent a problem since they occur in large volume and thus take up considerable transportation space in the case of disposal, i.e. the return to steel production.

Therefore, one has already tried to comminute the wool-like shavings, e.g. to tear up with rotating knives, which does not lead to the desired result because, on the one hand, introduction into the effective range of the knives makes problems since the material springs back very strongly and, on the other hand, rapidly rotating knives are jammed by the metal shavings.

Tapes and similar film-like articles tend to wind around the comminution device, which leads to frequent interruptions.

Similar problems arise in the case of the comminution of household waste, for which reason reliable, small devices are not on the market.

For the comminution of materials, devices are known with comb-like, interengaging knife or bar rows, extending from above downwardly and forming a wedge-shaped cutting gap, see e.g. DE-A-24 20 913 and U.S. Pat. No. 3,346,202. However, the cutting elements thereby perform an oscillating movement, i.e. forwards and backwards movement of the scissor-like cutting movement take place on precisely the same path. The above-mentioned materials can thus not be satisfactorily comminuted.

Therefore, the present invention has set itself the task of providing a device with the help of which comminutsble industrial waste and material from the private household can be comminuted in a very simple and reliable way, thereby, furthermore, it is also ensured that the cleaning of the device, e.g. in the case of change of the supplied material to be comminuted, is possible in a very easy way.

According to the invention, the solution of this task takes place with a device having the features of the main claim, advantageous embodiments being found in the subsidiary claims.

The comminution process takes place as follows: The comb-like engaging cutting bars are moved against one another with relatively low frequency in a scissor-like manner, whereby, in the upper part of the V-shaped introducing wedge, the material is compacted. Compacted material heeds less space and, therefore, is moved to the lower part of the introducing wedge until it is gripped by the cutting bar and is cut or broken up. Since the process can take place relatively slowly, no all too great forces are necessary for the swivelling movement so that, in principle, this can be carried out manually.

However, simultaneously with the scissor-like movement, because of the crank drive, an up and down movement of the knives takes place, whereby the angle between the knives is reduced in the case of the downward movement and the material to be comminuted is thereby drawn into the cutting region.

The simultaneous cutting movement and the swivel movement resulting by the crank can, in principle, be provided according to the invention in two ways. First, the knives can be assembled in s frame and be rigidly combined with one another, whereby the frame is coupled to a shaft via one or more lower bridges so that the bridge is forced around the shaft by the engaging movement and the knives are thus swivelled on a circular path with the radius of the length of the bridge. In the case of this solution, it is advantageous to close the frame (rigidly) fixed to the bridge via a lower shank and to let the knives of the counter frame to pass through in comb-like way and to allow to rest on the lower shank.

A further very important advantage of the solution according to the invention is that the cutting device can be very easily removed from the device, which considerably simplifies the changing of the tools or the cleaning of the device. Since the cutting combs grip through one another and are open at the lower side, they can easily be pulled out after removing the upper bearing.

The knife frames can be correlated in their intermediate spaces with wiping elements which are fixed, for example, on the opposite walls of the housing.

The invention is not restricted to opposing, plain cutting elements; the elements can be formed angular or rounded along the cutting line, whereby e.g. also the cutting region has its deepest point in the middle. For this purpose, it is merely necessary individually to mount the knife frames of the second element each separately movable. Besides the low working frequency, a relatively short swivelling movement is, in most cases, sufficient for the comminution, so that the device can be of small construction. Since e.g. the shavings are produced continuously in the case of turning and also in the case of use of such a device in the household, only small quantities are to be comminuted and a short-time processing of large volumes is not necessary, small single station devices can also be produced at low cost.

Similarly, no high requirement is made for the motor capacity since very high transmission ratios are possible. Advantageously, the motor thereby drives an eccentric with which is fixed the upper rim of the frame of the first cutting element, preferably on both ends, and whereby preferably both cutting elements are moved towards each other. Such a drive is constructionally not expensive and of great durability.

Furthermore, the above-mentioned springing back of the material to be comminuted can, according to the invention, be reduced by rows of barbed teeth with horizontal teeth flanks, arranged above the cutting bar, which hold down the material in the case of compacting and simultaneously additionally deform it.

The second cutting element which can pass through the first one is advantageously detachably connected with the wall of the housing in order to be able to remove this for cleaning purposes. For this purpose, at the end on the upper fixing of the second cutting element, e.g. spring-loaded pins can be provided which engage with appropriate pocket holes at the end of the bearing or the second element is simply stuck into the bearing.

The first cutting element can also be removably connected with its bearing and its motor.

A second possibility of the overlapping of cutting and swivelling movements produced by the crank consists in mounting the knives on a crank shaft and fixing the former against arms which rest on both sides near the cutting region, instead of mounting it against the rotably-mounted bridge, or the shank which on the lower side connects the cutting comb. In this way, on the crank shaft can be provided separate eccentrics for each knife so that e.g. in the case of offsetting in each case of 90°, only every fourth knife (of e.g. about 20) runs with identical movement.

The arms can be supported by pneumatic springs relative to the housing so that these move backwards in case of overload and prevent the destruction of the knives.

Advantageously, as also in the case of the above-described embodimental form, the knives can have a saw-like shape and/or be bulged towards the cutting region.

Furthermore, a further important improvement of the present invention consists in saw discs being mounted between the knives. These grip through the gaps necessarily present between the knives for the reception of the opposite-lying ones and are so dimensioned and mounted that the teeth of the saw discs project over the knives in the case of their backwards movement, remove attached parts, possibly comminute against the knives and transport downwardly to the lower cutting region, i.e. the turning direction of the saw discs is not the same as the opposite-lying ones.

In the case of the bringing together of the knives and the swivelling inwardly and downwardly thereby taking place, the knives again move beyond the saw discs end possibly again remove adhering material from the discs so that the knives and the saw discs mutually clean each other alternatingly.

Below the knives, a drawer is proved which collects the emerging small material. Several drawers can be placed on top of one another so that in the case of changing the material to be comminuted (change from synthetic material to food residues or cardboard etc.) different drawers can also be inserted in which the material can be collected.

The motor for driving the knives is preferably equipped with an overload protection which turns off if the power consumption is too high, which is necessary if accidentally parts are inserted which cannot be comminuted in order thereby to protect the knife frames against destruction.

In addition, the safeguard is so arranged that, after the stopping of the cutting movement, the cutting elements are drawn back into the starting position, i.e. the biggest opening angle.

The knife frames can be provided with wiping elements projecting into their gaps which can e.g. be fixed to the opposite-lying walls of the housing.

It is suggested to close the housing with a swivellable closure, whereby this is connectable with the motor or its housing and the eccentric is swivellably mounted in such a way that, in the case of opening of the closure, the first cutting element is drawn back to the biggest opening angle. This connection can be released so that the space behind the cutting element is accessible for cleaning purposes.

In the inside of the device, nozzles for the introduction of cleaning fluid can be provided which e.g. free the above-mentioned shavings from adhering drill fluids so that the comminuted shavings can be worked up directly.

The present invention is explained in more detail by the embodiments example with reference to the accompanying Figures.

The device consists of a housing 1 with the two cutting elements 2, 3 provided therein. The cutting elements each have rows of knife bars 4, which engage in the lower region and thereby form s row of scissors.

Figure 1:
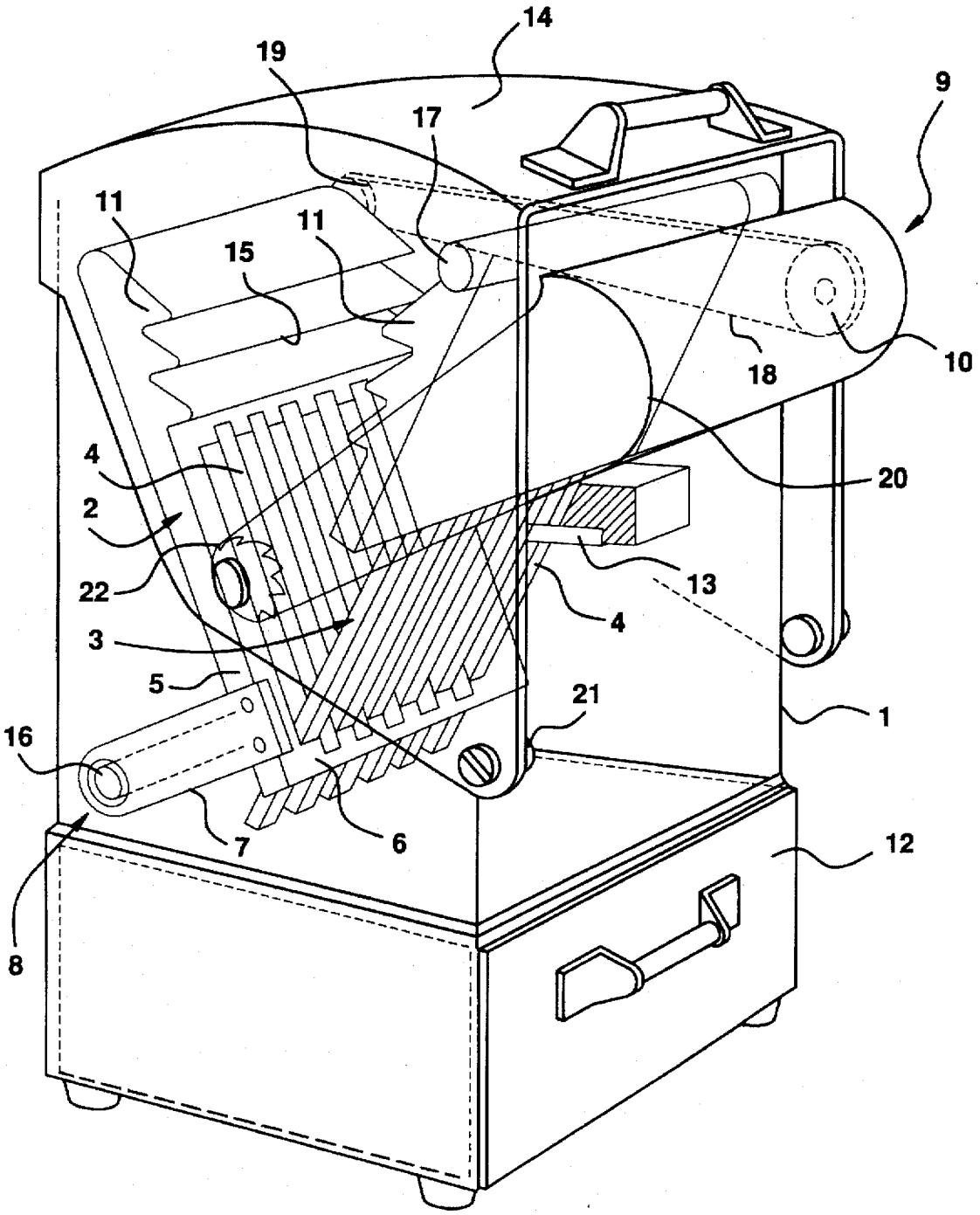
FIG. 1 shows this in three dimensional view

The cutting element 2, shown in FIG. 1 on the left has a frame 5 to which the knife bars are fixed, whereby the knife bars of the second cutting element 3, shown on the right, rest on the lower shank 6 of the frame 5 or are pressed against this during the cutting process.

The first cutting element 2 has bridges 7 fixed on both sides of the frame which are mounted vise shaft 16 and shift the turning axle with regard to the lower edge of the frame 5 backwards in the direction of the well of the housing, so that a turning of the first element around the shaft 16 simultaneously with the change of the angle produces an upward or downward movement.

The second cutting element 3 is open on its lower side and can be inserted between the knife bar 4 of the first cutting element 2 or removed therefrom.

The second cutting element 3 is turnably mounted on the upper end to the oppositely-lying well of the housing by a shaft 17, whereby the connection with the well of the housing is releasable, e.g. by spring-loaded pins (not shown) engaging from the outside into pocket holes, in order to be able to withdrew the second cutting element 5 after opening of the cover 14 for the cleaning of the knives and/or the interior. In especially preferred way, the shaft 17 (together with the cutting element 3) is inserted into the housing or a fixture attached to this. Above the cutting elements 2, 3, movable teeth rows 11 with horizontal tooth flanks 15 are present which are tilted downwardly and thereby hold the inserted material in a barb-like manner.

The teeth can be especially closer to each other than shown and also engage into one another in order to compact and to form the material to be comminuted before the gripping by the knife bars.

The first cutting element 2 is turnably mounted on an eccentric 10 around the axis 16, whereby this is connected via a connecting rod with the axis 19 and is set in motion by a motor drive 9.

The motor 9 can be present in its own motor housing 20.

The cover 14 is tiltably mounted on the housing in bearings 22. The motor housing 20 is also tiltable by bearings 22. This motor housing 20 is connected via the eccentric 10 with the first cutting element 2 in such a way that, by tilting back of the cover 14, around the pins 21, the first cutting element 2 is brought from its upright position into an illustrated backward position in order to provide the biggest possible filling space.

For cleaning purposes, the pins 21 can be withdrawn and thereby the motor housing 20 end thus the cutting element 2 brought into a lower or upright position.

Below the cutting elements, collecting containers in the form of drawers 12 can be provided into which the comminuted material falls, whereby, for different materials, superimposed exchangeable drawers are possible. The knife bars 4 can be combined with movable or rigid wipers 13 by special fixings 21.

Figure 2:
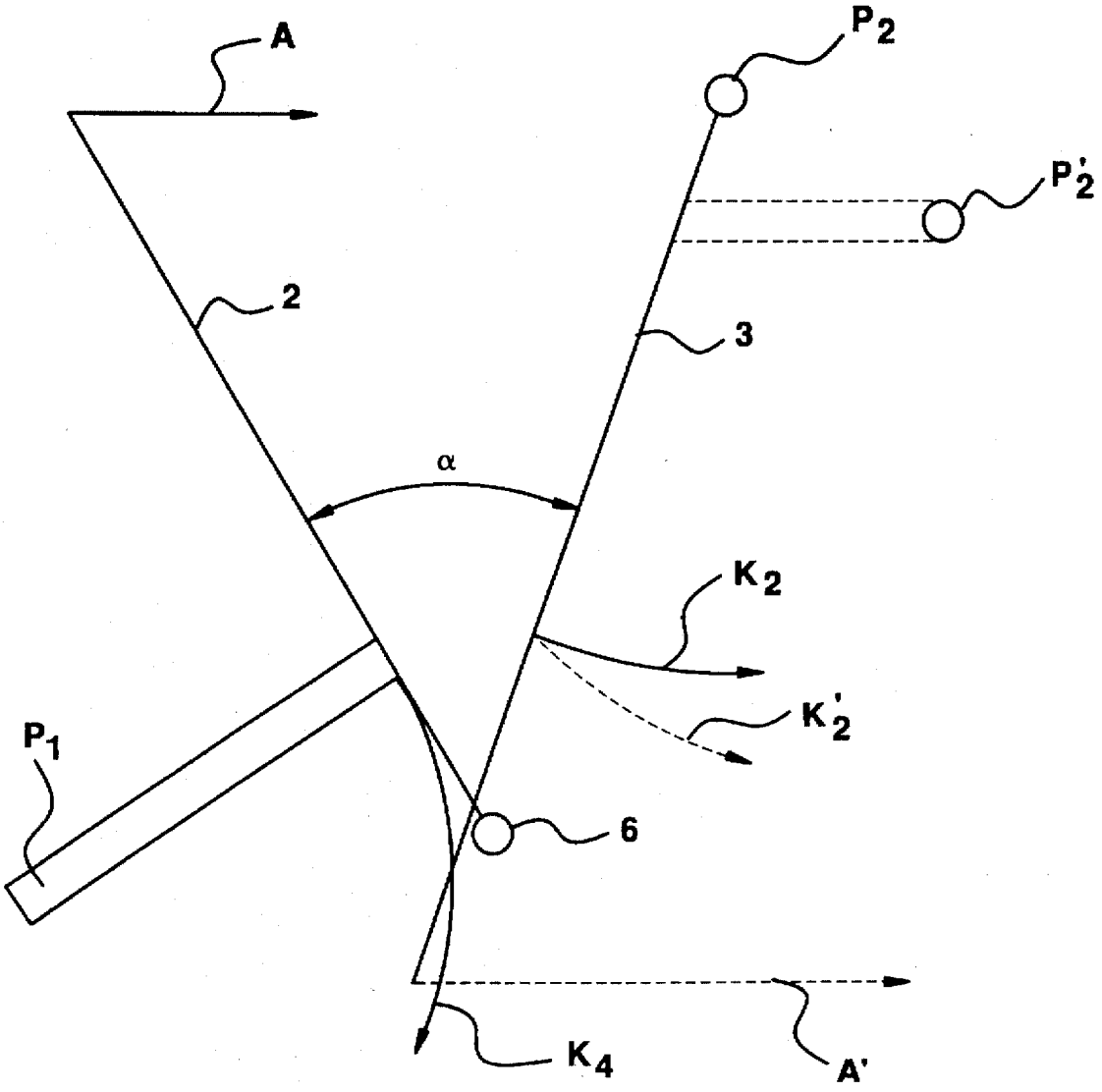
FIG. 2 shows the functional scheme

FIG. 2 shows the two interengaging cutting elements 2 and 3, whereby the first one is rotatably mounted around the point $P_1$ which lies outside of the plane of the element so that all points of the element move in circular paths $K_1$ around $P_1$ and, besides the horizontal one, show a significant vertical movement.

The element 3 is turnable around $P_2$, all points moving on circular paths $K_2$ with a predominantly horizontal component in the case of change of the cutting angle a, whereby the knives of the element rest on the shank 6 of the first element, i.e. are pressed down by the material to be comminuted. In principle, a circular path $K_2$, can also be produced when the turning point $P_2$ is displaced vis an additional lever $P_2$, in order also to impart to the second cutting element 3 a bigger downward component. $P_2$ and $P_2$, can, in principle, also lie lower than shown in order e.g. to strengthen the compacting before the cutting.

Force A used for the comminuting acts on the top of the first cutting element A (eccentric drive). An additional drive A' of the second element is possible but necessitates its dismantling before pulling out.

Furthermore, it is possible also to rotate both rows of knives on their upper end and also to provide them individually with lower bearings, which provides the possibility that the devices give way if a predetermined force is exceeded. In arising of such a case, the knife rows with the device move outwardly and open the cutting gap, so that non-comminuted material (e.g. with hardness close to or greater than the hardness of the knife) can emerge below without damaging the knives.

Figure 3:
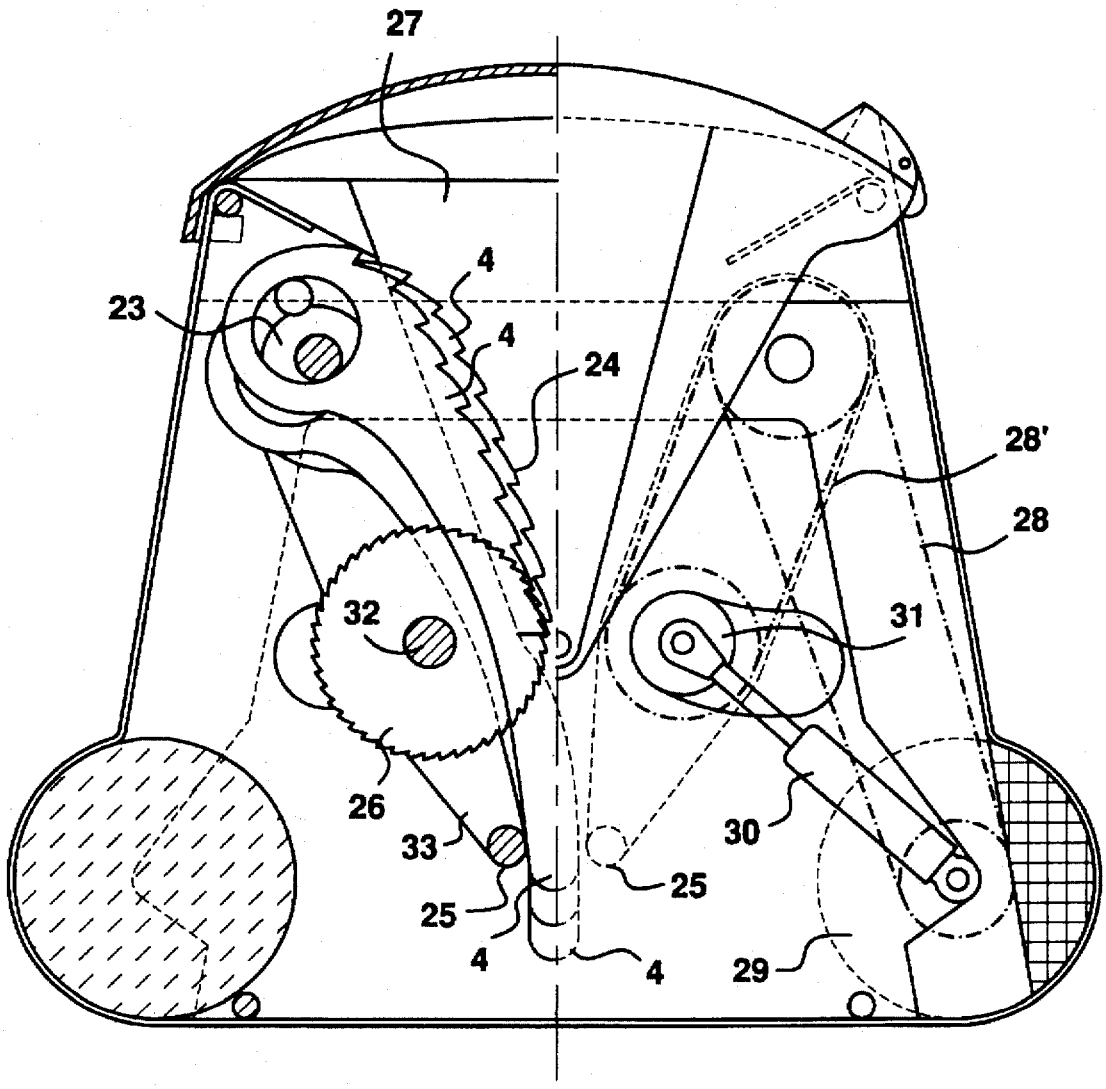
FIG. 3 shows an embodiments form with double sided crank drive.

FIG. 3 shows an especially preferred embodimental form of the present invention, in which the opposite-lying, interengaging rows of the knives 4 (for a better view, only the left row in shown) are mounted on the head end in an eccentric shaft 23 which are, in each case, driven via a chain 28 by the motors 29. The eccentrics can e.g. be positioned at an angle of 90° towards each other.

Furthermore, the knives 4 can be curved as illustrated, i.e. means bulging inwardly and provided with teeth 24.

The knives lie below against outer swivel arms 25 which are supported via pneumatic springs 30, whereby the spring pressure is matched with the strength of the knives so that they can give way when overloaded.

Between the knives 4 are placed saw discs 26 which lie in the gaps formed by the interengaging knives and their diameter and arrangement on the axis 32 is so chosen that, in the case of downward movement of the knives 4, they are covered by these and, in the case of drawing out, they project into the cutting region 27 and, in this way, even comminute material adhering against the knives 4 and, on the other hand, clean these and convey the material downwardly.

The saw discs 26 can also be supported by pneumatic springs, they are driven via the eccentric shaft 23 by chains 28, 28'. Furthermore, as shown, the arm 25 and the saw disc axes 32 rest on a support pair 33 tiltably positioned on both sides of the knife 4 and, in addition, the saw discs 26 can be connected to a sliding clutch 31 so that these can stop for a short time and, after wiping off of the knives 4, can be started again.

List of References

1 housing
2, 3 cutting elements
4 knife
5 frame
6 shank
7 bridge
8 joint
9 motor drive
10 eccentric drive
11 teeth rows
12 drawers
13 wiper
14 cover
15 teeth flanks
16, 17 shafts
18 connecting rod
19 axis (bolt)
20 motor housing
21 catch pin
22 bearing for cover 14 and motor housing 20 (with ratchet)
23 eccentric shaft
24 teeth
25 swivel arm
26 saw disc
27 cutting region
28, 28' chain
29 motor
30 pneumatic springs
31 sliding clutch
32 saw disc axis
33 support

I claim:

1. A device to comminute materials comprising:

a housing; and a first cutter and a second cutter extending within the housing, the first and second cutters diverging from one another toward a top of the housing;

wherein each of the first and second cutters include rows of spaced knives, knives of the first cutter being engaged with the knives of the second cutter; and wherein the first and second cutters are driven to simultaneously carry out a swiveling movement about an axis and a scissor-like movement.

2. A device as claimed in claim 1, further comprising a crank to drive the first and second cutters, and wherein the axis is an axis of the crank.

3. A device as claimed in claim 1, wherein the knives of the first cutter are supported by a frame with a lower shank and are adapted to tilt over at least one bridge extending from the frame, so that the first cutter simultaneously moves in a downward direction while tilting.

4. A device as claimed in claim 3, wherein the knives of the second cutter rest on the lower shank of the frame of the first cutter and are pivotally supported by an upper bearing.

5. A device as claimed in claim 1, wherein the first cutter is driven by a motor.

6. A device as claimed in claim 5, wherein the motor is an eccentric drive motor.

7. A device as claimed in claim 1, further comprising inclined rows of teeth extending above the first and second cutters.

8. A device as claimed in claim 1, wherein the second cutter is releasably mounted to the housing.

9. A device as claimed in claim 1, further comprising drawers located below the first and second cutters to receive comminuted materials from the device.

10. A device as claimed in claim 1, further comprising wipers extending adjacent at least one row of knives.

11. A device as claimed in claim 1, wherein at least one of the knives has teeth.

12. A device as claimed in claim 1, wherein at least one of the knives is mounted to a drivable eccentric shaft.

13. A device as claimed in claim 1, wherein the knives are curved.

14. A device as claimed in claim 1, further comprising at least one saw disc extending through at least one gap between adjacent knives.

15. A device as claimed in claim 5, wherein the motor includes an overload safety device.

16. A device to comminute materials comprising:

a housing;

a first cutter and a second cutter extending within the housing, the first and second cutters diverging from one another toward a top of the housing; and lower swivel arms;

wherein each of the first and second cutters include rows of spaced knives, knives of the first cutter being engaged with the knives of the second cutter; and wherein the first and second cutters are driven to simultaneously carry out a swiveling movement about an axis and a scissor-like movement, and a plurality of the knives lie against the lower swivel arms.

17. A device to comminute materials comprising:

a housing having a housing cover;

a motor having a motor cover; and a first cutter and a second cutter extending within the housing, the first and second cutters diverging from one another toward a top of the housing;

wherein each of the first and second cutters include rows of spaced knives, knives of the first cutter being engaged with the knives of the second cutter;

wherein the first and second cutters are driven to simultaneously carry out a swiveling movement about an axis and a scissor-like movement; and wherein opening the housing cover moves the first cutter and the motor cover backward.

18. A method of comminuting materials comprising:

providing a housing;

providing first and second cutters having rows of knives extending within the housing, the first and second cutters diverging from one another toward a top of the housing;

driving the first and second cutters to simultaneously carry out a swiveling movement about an axis and a scissor-like movement.

19. A method as claimed in claim 18, further comprising:

providing saw tooth discs between adjacent knives;

extending the saw tooth discs into a cutting region between the first and second cutters such that they remove adhered material from the knives;

conveying the removed material downward through the cutting region.

20. A method as claimed in claim 19, further comprising:

supporting the rows of knives from below, and asynchronously driving the knives to successively bring them into a cutting position.

* * * * *